US006145885A

United States Patent [19]

Scrymgeour et al.

[11] Patent Number: 6,145,885

[45] Date of Patent: Nov. 14, 2000

[54] VARIABLE IMAGED BREAK-OPEN TICKET

[75] Inventors: Lyle Harold Scrymgeour, Dugald; Michael John Brickwood, Winnipeg, both of Canada

[73] Assignee: Pollard Banknote Limited, Winnipeg, Canada

[21] Appl. No.: 09/406,690

[22] Filed: Sep. 27, 1999

[51] Int. Cl.[7] ..... B42D 15/00

[52] U.S. Cl. ..... 283/94; 283/903

[58] Field of Search ..... 283/903, 51, 61, 283/62, 65; 273/148 R, 139, 138.1

[56] References Cited

U.S. PATENT DOCUMENTS

| | | | |
|---|---|---|---|
| 4,174,857 | 11/1979 | Koza . | |
| 5,217,258 | 6/1993 | Sanderson . | |
| 5,253,899 | 10/1993 | Greewood . | |
| 5,542,710 | 8/1996 | Silvershotz et al. | 283/903 X |
| 5,562,284 | 10/1996 | Stevens | 283/903 X |
| 5,618,112 | 4/1997 | Lovell | 283/903 X |

FOREIGN PATENT DOCUMENTS

WO 98/57715 of 0000 WIPO .

*Primary Examiner*—Willmon Fridie, Jr.
*Attorney, Agent, or Firm*—Adrian D. Battison; Murray E. Thrift

[57] ABSTRACT

Described herein is a break-open lottery ticket and a method of producing same. The lottery ticket includes variable imaged lottery indicia printed directly onto the ticket, meaning that bar codes and other similar features can be added for increased security and facilitated redemption. The indicia are covered by a break open window allowing the indicia to be exposed for playing the game. The indicia are printed onto a white lily pad in two or more colors allowing a high quality graphic image to be provided to attract the player.

13 Claims, 7 Drawing Sheets

VARIABLE IMAGED BREAK-OPEN TICKET

VARIABLE IMAGED BREAK-OPEN TICKET

The present invention relates generally to the field of lottery tickets.

BACKGROUND OF THE INVENTION

Lottery tickets are well known and widely sold and typically comprise a sheet material of paper or card stock on which is printed lottery information and various indicia for the playing of one or more games. Many such games are instant win type games where the player can play the game or games by carrying out various functions, for example, opening pull tabs on a break-open ticket. Such tickets are also known variously as pull-tabs, pickle cards, jar tickets, hard cards and charitable gaming tickets.

Break-open tickets are typically constructed by printing a sheet containing multiple combinations of lottery indicia thereon. This sheet is then cut into sections. The opposite side of this sheet includes prize categories, serial number etc. A second sheet contains removable tabs or break-open windows is then mounted onto the card stock such that the break-open windows overlap the lottery indicia. However, break-opens prepared in this manner have the disadvantages that they are cumbersome to prepare, have a limited set of winning symbols and require manually checking at the time of redemption.

U.S. Pat. No. 4,174,857 (Koza) and U.S. Pat. No. 5,253,899 (Greenwood) each disclose a combined ticket construction in which a second layer is applied or folded over the basic ticket to improve security. U.S. Pat. No. 5,562,284 discloses a break-open ticket with a second level of break-open. U.S. Pat. No. 5,217,258 (Sanderson) discloses a two sided break-open ticket where the windows are arranged back to back opening onto a single center sheet carrying the game data.

As shown in published PCT International application No. WO 98/57715 published Dec. 23, 1998 of the present applicants there is provided a pouched lottery ticket which is supplied in a fan folded continuous strip arrangement for separating each ticket from the next at a dispensing station. The disclosure of this publication is hereby incorporated herein by reference.

Also in the prior art is a sample of a game ticket manufactured by Scientific Games and known under the trademark "Zip-Tix". This comprises a ticket formed of a paper back sheet with a foil or metalized front sheet. The front sheet has a single break-open window which can be torn open to reveal a black printed image of game indicia printed onto a grey security coating. The printed image includes a validation number printed under the break-open window so that it is revealed when the window is opened. The game indicia appear to be printed using an ink jet system. What appears to be a validation number is printed below the game data.

SUMMARY OF THE INVENTION

It is one object of the present invention to provide a break-open ticket having improved validation and security features and ergonomically improved construction.

According to a first aspect of the invention, there is provided a method of preparing a lottery ticket comprising:

- providing a first continuous substrate sheet material in a first strip having a front surface and a rear surface;
- providing a second continuous substrate sheet material in a second strip having a front surface and a rear surface;

- printing promotional graphics onto said front surface of each of the first and second strips;
- printing lottery game indicia onto said rear surface of said first strip wherein the lottery game indicia are applied by variable image printing;
- connecting the rear surface of the first strip to the rear surface of the second strip to form a row of connected tickets;
- providing between each ticket and the next a line of weakness for separation of each ticket from the next;
- and providing a plurality of openable windows on the second strip so that each ticket has at least one window for exposing the second lottery game indicia on the rear surface of the first strip.

Preferably the lottery game indicia are applied by variable image printing onto a white lily pad.

Preferably the lottery game indicia are applied by variable image printing using two or more colors.

Preferably the lottery tickets are fan folded along each junction with the fold at the front edge of each lottery ticket construction being in a direction opposite to the fold at the rear edge of each lottery ticket construction so that the lottery ticket constructions lie each on top of and parallel to the next.

Preferably the lottery indicia includes a variable image bar code for validating the lottery ticket.

According to a second aspect of the invention, there is provided a lottery ticket construction comprising:

- a first continuous substrate sheet material in a first strip having a front surface and a rear surface;
- a second continuous substrate sheet material in a second strip having a front surface and a rear surface;
- promotional graphics on said front surface of each of the first and second strips;
- lottery game indicia printed by variable image printing onto said rear surface of said first strip;
- the rear surface of the first strip being connected to the rear surface of the second strip to form a row of connected tickets;
- a line of weakness between each ticket and the next for separation of each ticket from the next;
- and a plurality of openable windows on the second strip so that each ticket has at least one ticket for exposing the second lottery game indicia on the rear surface of the first strip.

According to a third aspect of the invention, there is provided lottery ticket construction comprising:

- a first substrate sheet material having a front surface and a rear surface;
- a second substrate sheet material having a front surface and a rear surface;
- promotional graphics on said front surface of each of the first and second sheets;
- lottery game indicia printed by variable image printing onto said rear surface of said first sheet;
- the rear surface of the first sheet being connected to the rear surface of the second sheet to form a ticket;
- at least one openable window on the second sheet for exposing the second lottery game indicia on the rear surface of the first sheet;
- wherein the lottery game indicia includes a variable image bar code for validating the lottery ticket.

BRIEF DESCRIPTION OF THE DRAWINGS

One embodiment of the invention will now be described in conjunction with the accompanying drawings in which.

In the drawings like characters of reference indicate corresponding parts in the different figures.

DESCRIPTION OF THE PREFERRED EMBODIMENTS

Figure 2:
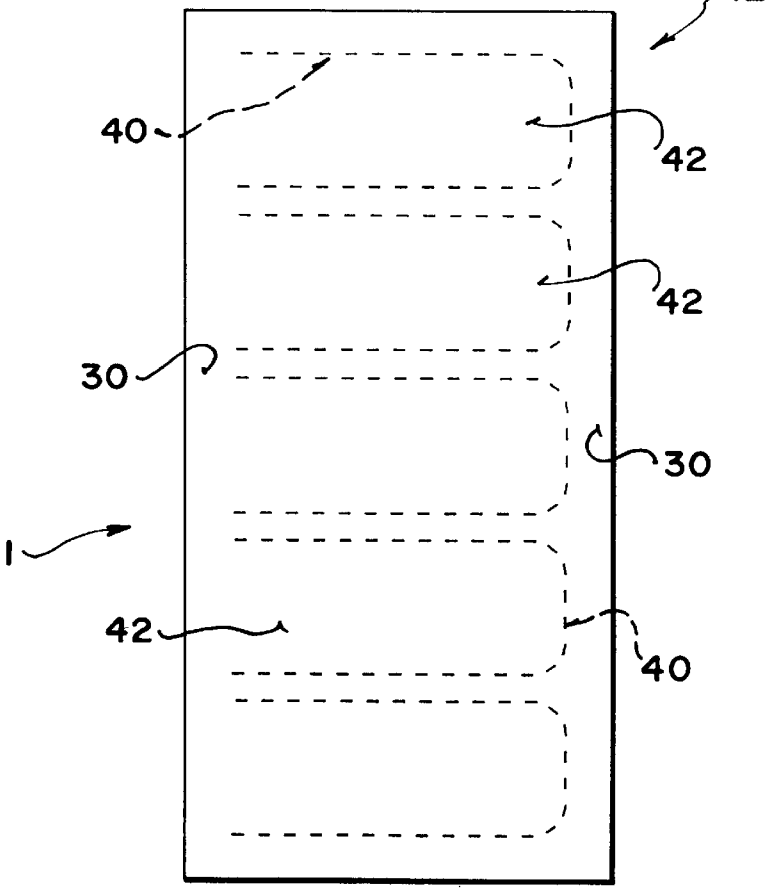
FIG. 2 is a rear view of the lottery ticket.
Figure 1:
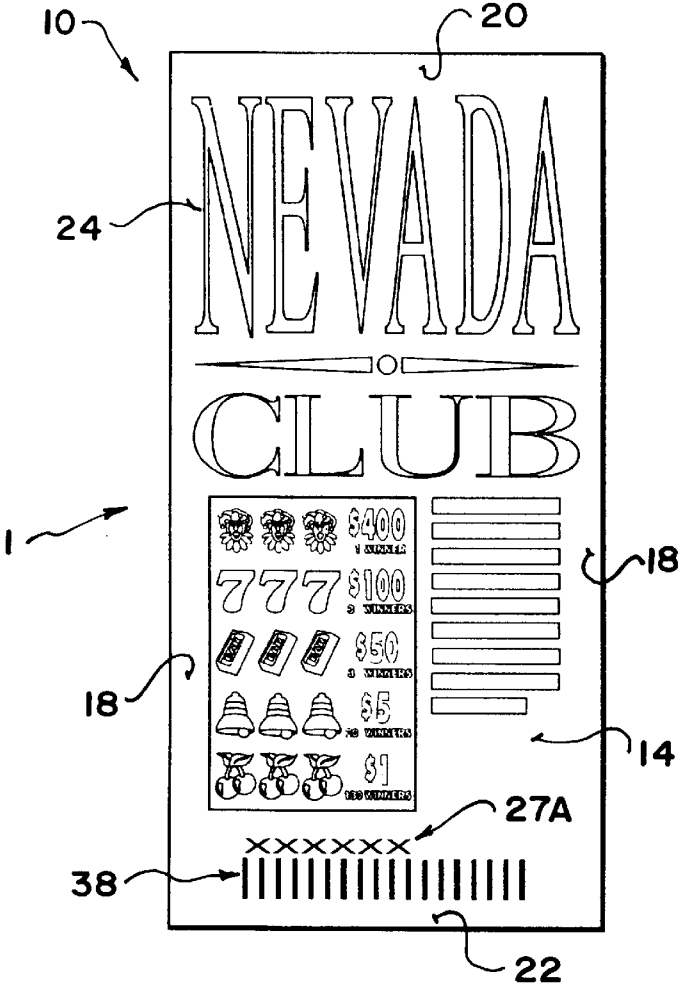
FIG. 1 is a front view of the lottery ticket.
Figure 3:
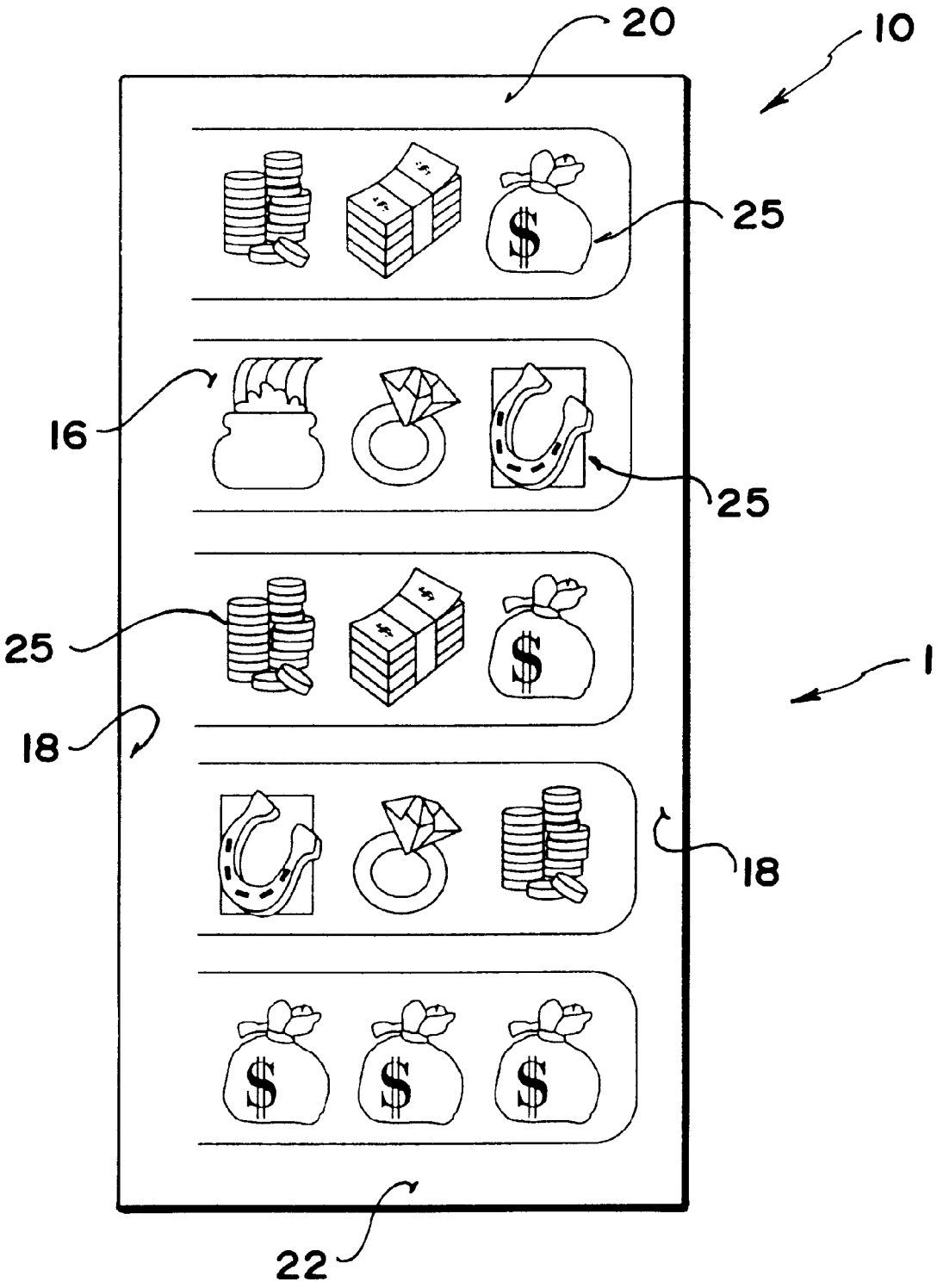
FIG. 3 is a rear view of the lottery ticket with the break-open windows opened to expose the game indicia.

Referring to FIGS. 1–3, a lottery ticket 1 comprises a first ticket portion 10 and a second ticket portion 12.

The first ticket portion 10 is formed by substantially flat substrate sheet material and has a front surface 14, a rear surface 16, side edges 18, a top edge 20 and a bottom edge 22 as shown in FIGS. 1 and 3. The front surface 14 has promotional graphics and lottery information 24 printed thereon as shown in FIG. 1. In some embodiments, the front surface 14 includes a bar code 38 for identification and redemption of the lottery ticket 1 as described below. The rear surface 16 has lottery indicia 25 variable image printed thereon as shown in FIG. 3. It is of note that the bar code 38 is related to and provides information on the lottery indicia 25 printed on the rear surface 16. Alternatively, a variable imaged bar code 38 may be printed on rear surface 16 which is related to game indicia 25. The bar code 38 may also include a human readable portion. A human readable portion of the bar code is indicated at 27A. Because the bar code is printed by variable image printing techniques, it is unique to the specific ticket and is not merely a number identifying particular winning indicia.

The second ticket portion 12 is formed by substantially flat substrate sheet material and has a front surface 26, a rear surface (not shown), side edges 30, as shown in FIG. 2. In some embodiments, the front surface 26 has promotional graphics or lottery information 24 printed thereon.

The lottery ticket 1 is formed by connecting the rear surface 16 of the first ticket portion 10 to the rear surface of the second ticket portion 12. In some embodiments, the rear surface 16 of the first ticket portion 10 is connected to the rear surface of the second ticket portion 12 by an adhesive along side edges 18, 30, top and bottom edges 20, 22 and between the windows.

The front surface 26 of the second ticket portion 12 includes lines of weakness 40 inside the side edges 30 of the second ticket portion 12. Specifically, the lines of weakness are arranged to form a plurality of break-open windows 42 positioned on the front surface 26 of the second ticket portion 12 opposite the lottery indicia 25 on the rear surface 16 of the first ticket portion such that opening the break-open windows 42 allows viewing of the lottery indicia 25, as described below. In some embodiments, the line of weakness 40 is introduced onto the front surface 26 of the second ticket portion 12 by die-cutting.

In use, the user purchases a lottery ticket 1. It is of note that as discussed above, the lottery ticket 1 is arranged such that the lottery information 24 is printed on one side of the lottery ticket 1 while the break-open windows are printed on the other side. In other embodiments, lottery information may be included on the same side of the lottery ticket 1 as the break-open windows. Following purchase, the user tears open the break-open windows 42 and views the lottery indicia 25 on the rear surface of the first ticket portion 10. The user then consults the lottery information 24 to determine if the lottery ticket 1 is a winner.

Figure 4:
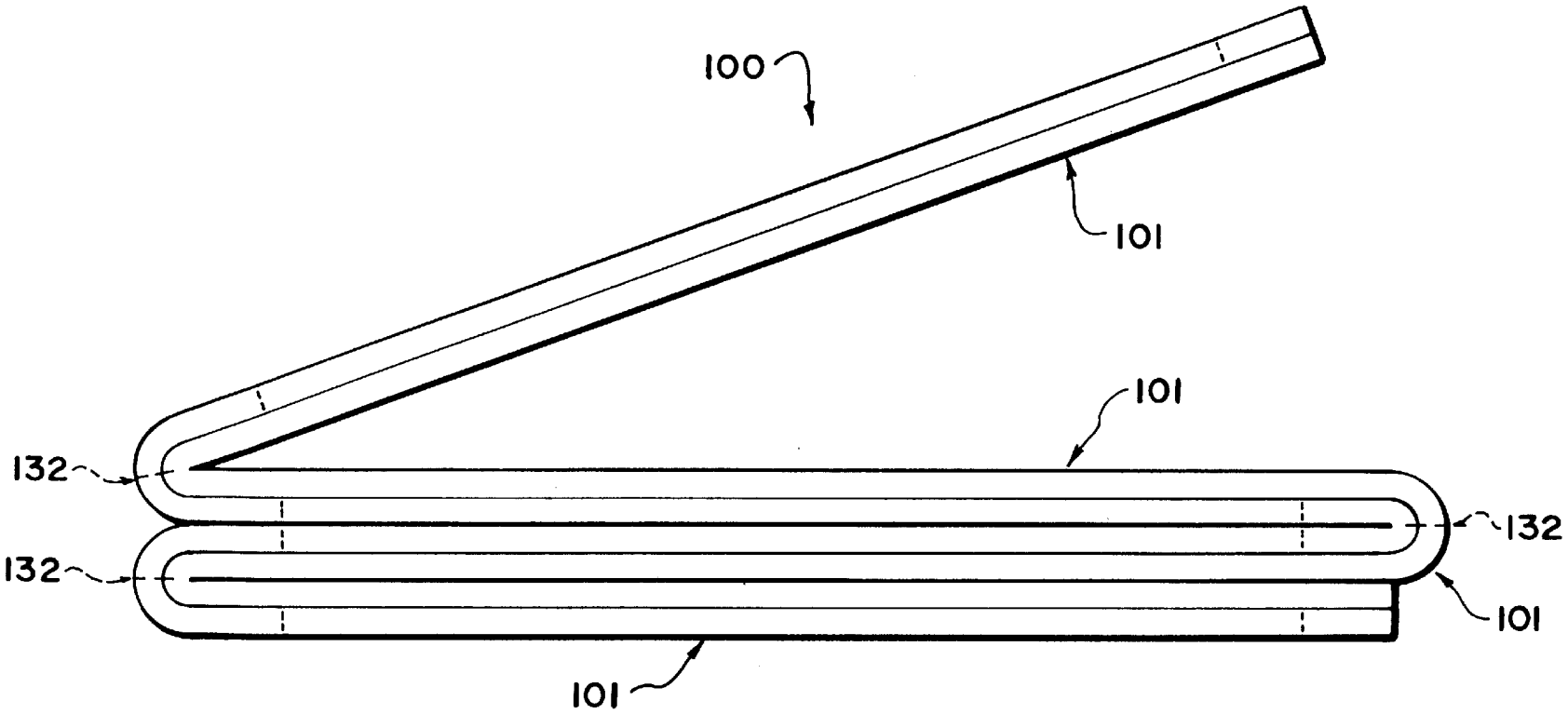
FIG. 4 is a side view of a lottery ticket construction including a strip of the tickets of FIG. 1.
Figure 5:
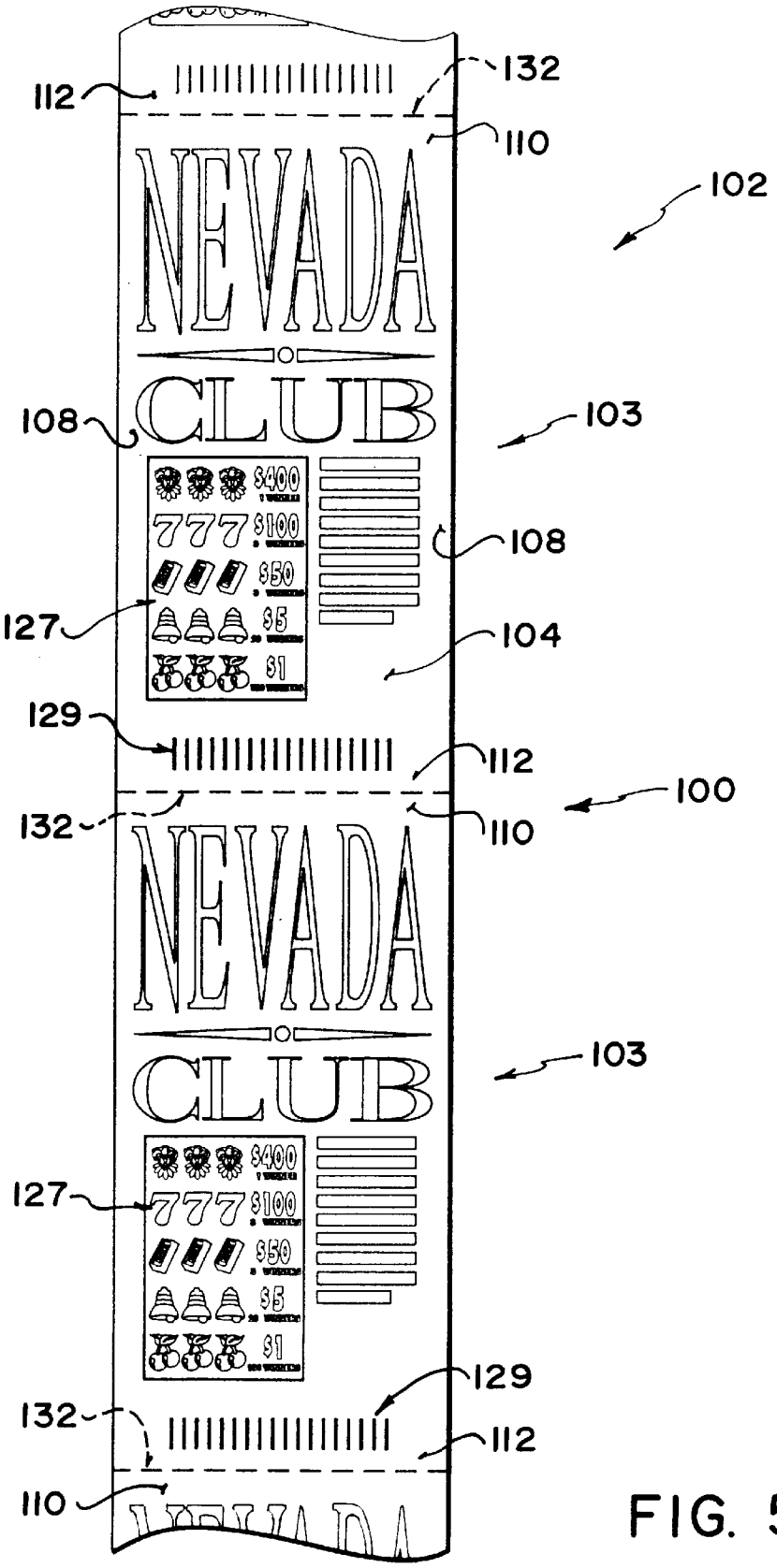
FIG. 5 is a front view of the first strip of the lottery ticket construction.
Figure 6:
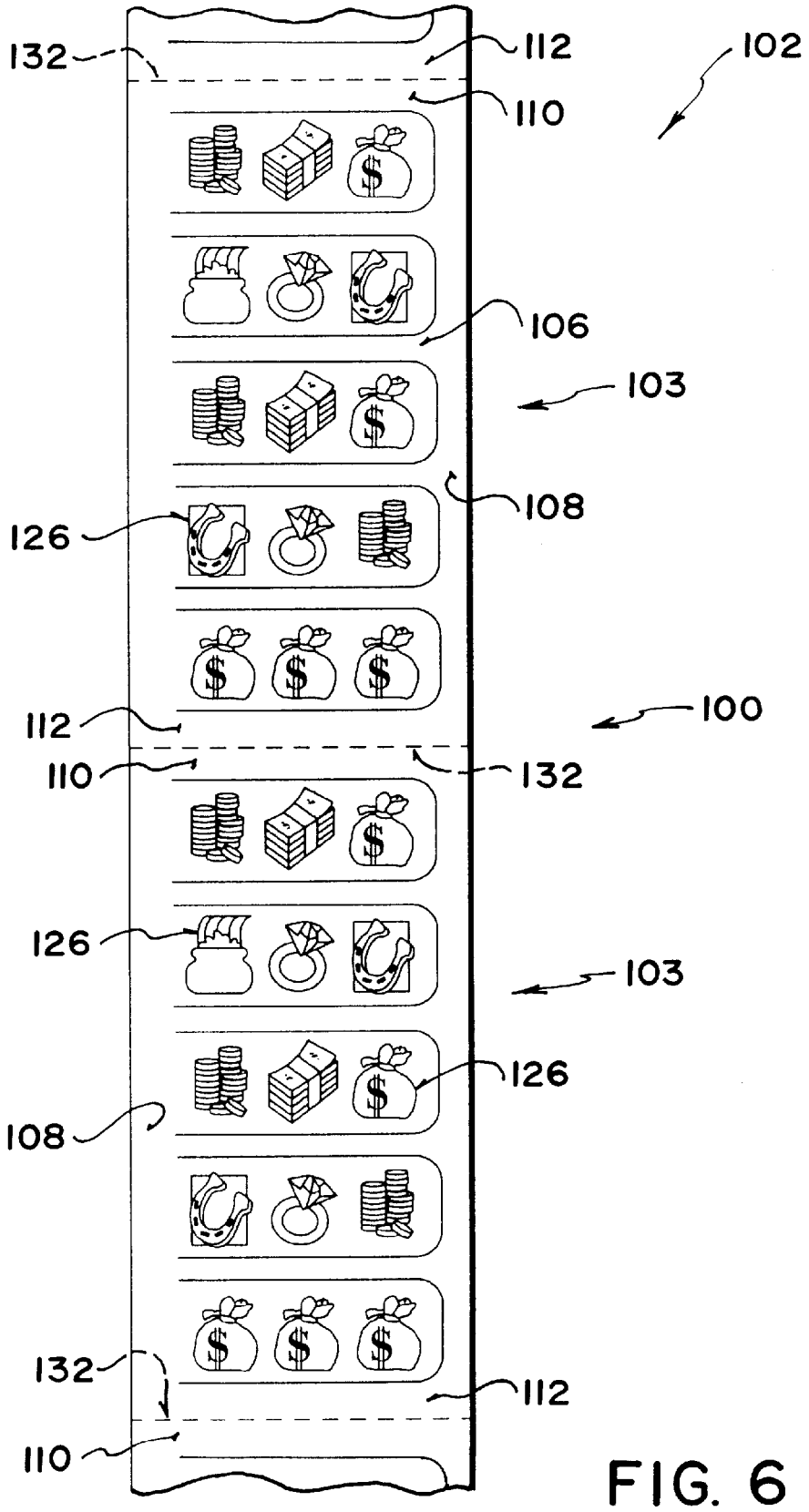
FIG. 6 is a rear view of the first strip of the lottery ticket construction.
Figure 7:
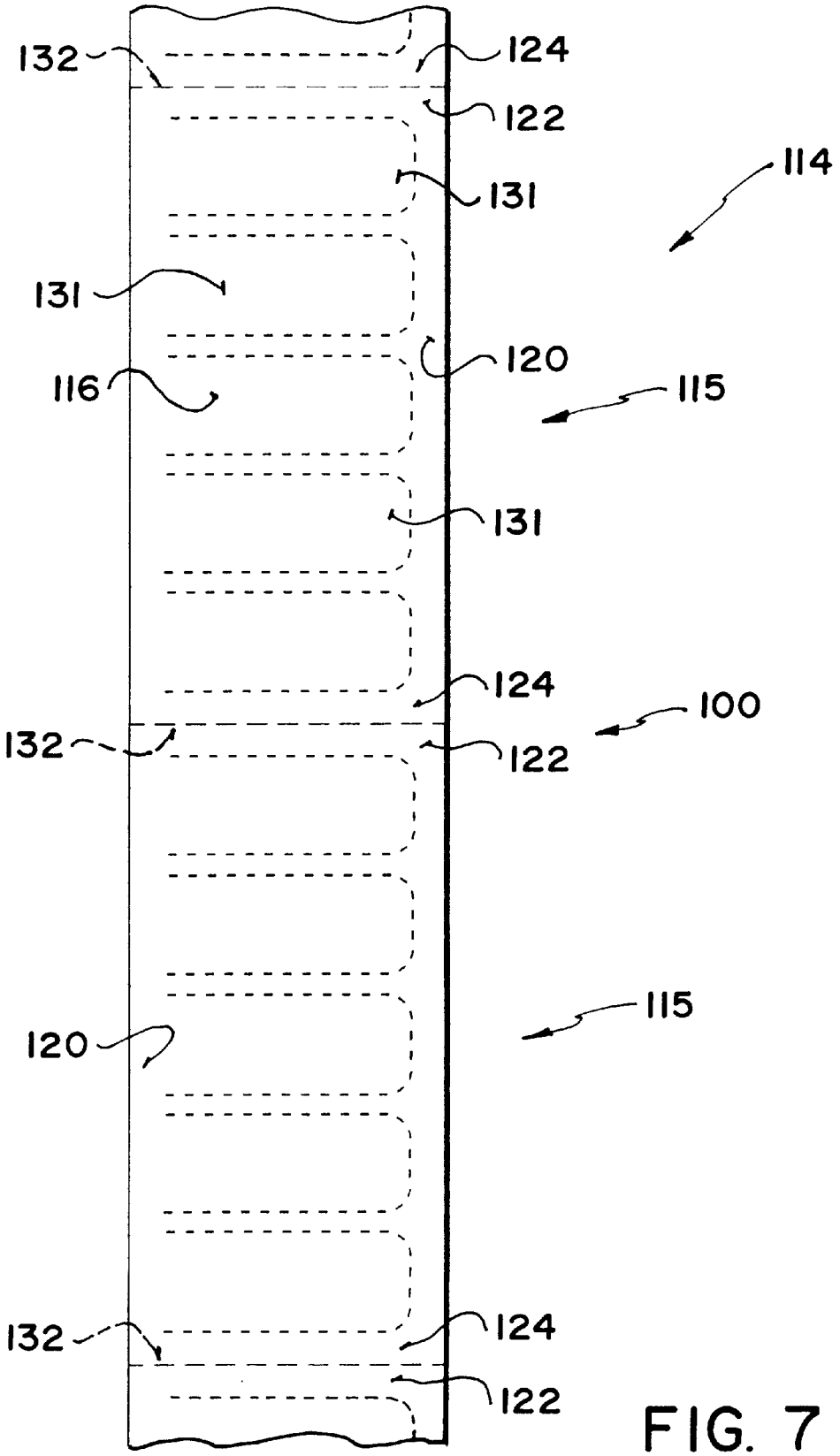
FIG. 7 is a rear view of the second strip of the lottery ticket construction.

Referring to FIGS. 4 to 7, a method of preparing a lottery ticket construction 100 comprised of a plurality of lottery tickets 101 comprises providing a first strip 102 composed of a plurality of first ticket portions 103 each composed of a substantially flat sheet material and having a front surface 104, a rear surface 106, side edges 108, top 110 and bottom 112 as shown in FIGS. 5 and 6 and providing a second strip 114 composed of a plurality of second ticket portions 115 each composed of a substantially flat sheet material and having a front surface 116, a rear surface (not shown), side edges 120, top 122 and bottom 124. A plurality of lottery indicia 126 are variable image printed at regular intervals on the rear surface 106 of the first strip 102 and promotional graphics and/or lottery information 127 are printed on the front surface 104 of the first strip 102. Specifically, the plurality of lottery indicia 126 and the lottery information 127 are printed onto the first strip 102 such that a representative one of the plurality of lottery indicia 126 and the lottery information 127 is between the top 110 and the bottom 112 of a representative one of the plurality of first ticket portions 103. In some embodiments, promotional graphics and/or lottery information are printed on the front surface 116 of the second strip 114. It is of note that the lottery information 127 may include a bar code 129 for identification. Specifically, the bar code 129 on the front surface 104 of a representative one of the plurality of lottery tickets 101 is related to and dependent upon the representative one of the lottery indicia 126 printed on the rear surface 106. Next, the rear surface 106 of the first strip 102 is placed in contact with the rear surface 118 of the second strip 114 and the first strip 102 and the second strip 114 are positioned relative to one another such that a representative one of the first ticket portions 103 is aligned with a representative one of the second ticket portions 115. In some embodiments, the rear surface of the second ticket portion 115 includes markings or the like for facilitating alignment. In some embodiments, the proper alignment of the first strip 102 to the second strip 114 may be confirmed manually. The second strip 114 is separated from the first strip 102 such that alignment is maintained and an adhesive is applied to the rear surfaces 106, 118 along the side edges 108, 120, top and bottom edges and between the windows. The rear surface 106 of the first strip 102 is then brought into contact with the rear surface 118 of the second strip 114 and the first strip 102 is connected to the second strip 114. A plurality of lines of weakness 130 are then introduced into the front surface 116 of the second strip 114 at regular intervals such that each line of weakness 130 extends around one of the lottery indicia 126 on the rear surface 106 of the first strip 102, thereby forming a plurality of break-open windows 131 for viewing the lottery indicia 126. The lines of weakness 130 may be introduced for example by die-cutting. In an alternative embodiment, the break-open windows 131 may be introduced into the front surface 116 prior to connecting the first ticket portion 103 to the second ticket portion 115.

A plurality of rows of perforations 132 are then introduced into the lottery ticket construction 100 at junctions between the top of a representative one of the plurality of lottery tickets 101 and the bottom of an adjacent one of the plurality of lottery tickets 101. As a result of this arrangement, the plurality of lottery tickets 101 can be separated into individual lottery tickets by tearing along a representative one of the plurality of rows of perforations 132. The plurality of lottery tickets 101 are fan folded and if desired the folds can be arranged along each of the plurality of rows of perforations 132 with the fold at the front edge of each lottery ticket being in a direction opposite to the fold at the rear edge of each lottery ticket so that the lottery tickets lie each on top of and parallel to the next, as shown in FIG. 4. Alternatively, the folds can be spaced along a number of tickets so that for each strip between two folds contains more than one ticket for example five such tickets.

Figure 8:
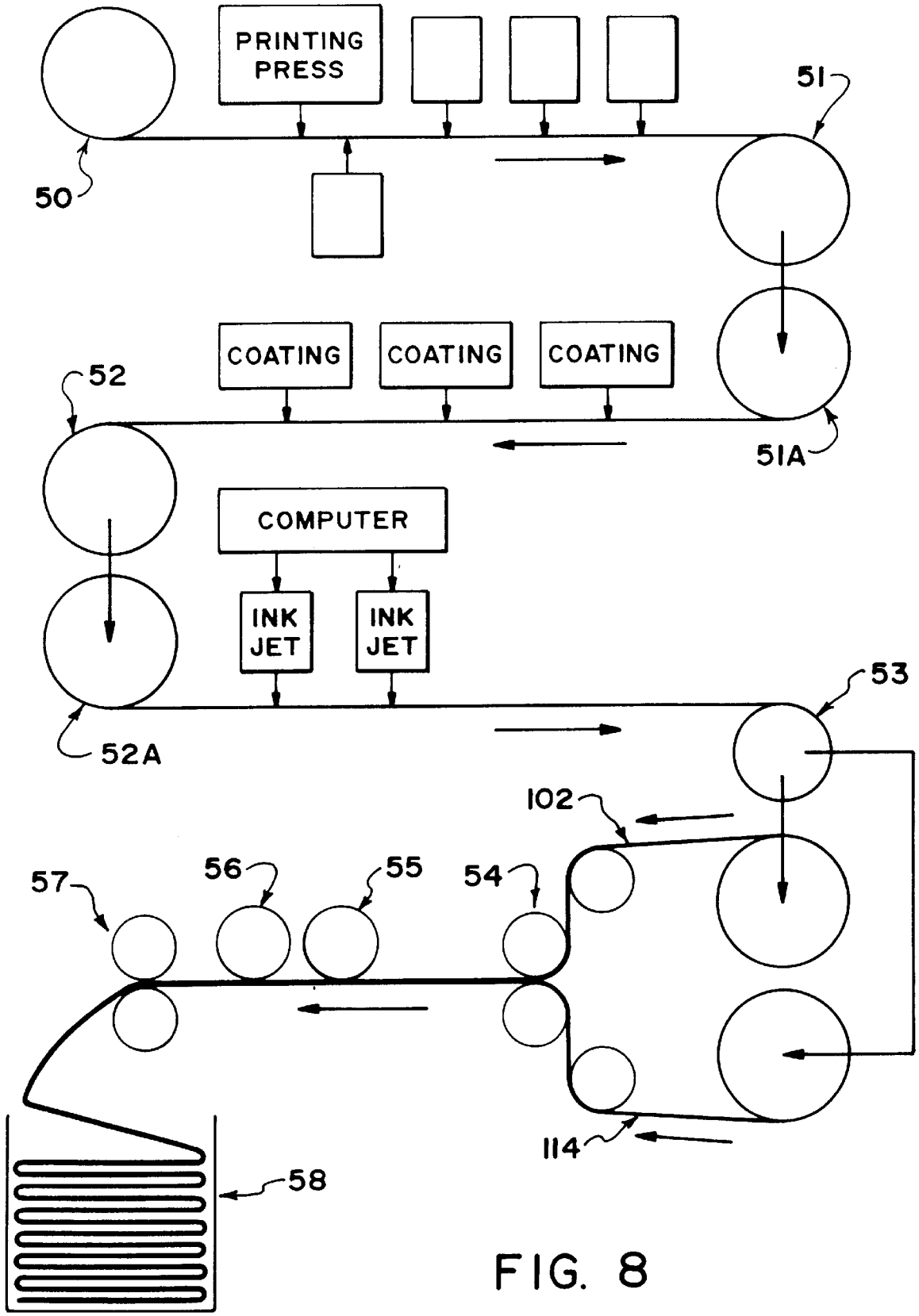
FIG. 8 is a schematic side elevational view of a process for forming he ticket assembly of FIG. 4.

In FIG. 8 is shown schematically the process described above. The process is shown in a number of discreet steps but it will be appreciated that the process can be integrated into a single continuous production line without the necessity for unrolling and re-rolling the strip in the separate steps as shown.

Thus in a first step of the process, an initial strip of blank paper stock is unrolled from a supply roll 50 and is rewound onto a rewind roll 51. As the strip is forwarded, graphics and base printing is applied onto the strip from a series of colour printing presses so as to provide preferably a full colour printing of both sides of the strip.

In the second step, the re-rolled roll is used as a supply as indicated at 51A and the strip passes through a coating station including a plurality of coating elements before being rewound at a rewind station 52. The coating elements provide a series of layers or lily pads over sections of the strip at which the lottery games are to be applied. This provides a security layer or coating for the strip which enhances security to prevent chemical, light or other attack onto the base paper stock to avoid improper examination of the tickets revealing the winning ticket without the necessity for scratching the scratch off layers. Various arrangements of security coating are known in the industry and thus this aspect is well known to one skilled in the art and further detail will not be described in detail herein. In some arrangements, the indicia can be printed directly onto the substrate.

The resultant or final layer of the security coating is generally a white lily pad so that the white layer does not interfere with or detract from the brightness of subsequent application of coloured printed materials or layers.

The re-rolled roll 52 is applied at a supply station 52A for a third step in the process where the strip is unrolled and re-rolled at a station 53. In the third step, the lottery indicia are applied to the white lily pad over the security layers previously described to provide the game data. The lottery indicia are applied by variable image printing techniques as opposed to use of fixed printing presses.

It will be appreciated that a printing press can apply only predetermined arrangements of characters which are set up in the printing press and cannot be readily or quickly varied. The variable image printing process to the contrary uses a computer controlled system to control conventional printing elements such as ink jet, bubble jet or laser so that the image applied can be varied to any particular requirement allowing each ticket to be entirely different from others. This technique can generate one color images, but more preferably two colors such as red and black or more color images.

The use of variable image printing techniques allows also the following advantages:

It avoids the use of a limited number of combinations of symbols in the game data which is otherwise available by conventional printing press.

The prize parameters, that is the arrangement and numbers of winning tickets relative to losing tickets, can be tailored to suit particular circumstances, customers or games and is not limited to the fixed arrangements available with the conventional printing press.

As the strip is continuous and is not cut from a press printed sheet, there are no markings or patterning of the substrate caused by mechanically cutting substrate pieces from a larger printed sheet, thus avoiding the possibility that the markings or patterning could be used to locate and identify winning tickets.

The application of a bar code (including machine and/or human readable portions) which is unique to the ticket and is applied directly with and at the same time as the game indicia to allow identification and validation of individual tickets.

Strips thus formed with the graphics printing, security coatings and game data are thus formed and available at the station 53. One of these strips is then used in a lamination process at laminating and calendaring rolls 54 together with a strip taken from station 51 which has only graphics and base printing. The laminated strips are then passed through a die cut roller system 55 and a kiss cut roller system 56 to apply the lines of weakness and perforations as previously described. The strip is then folded back and forth in a fan folding arrangement 57 to form a fan folded stack 58 of the finished tickets in the ticket assembly. The laminated tickets in the fan folded stack are also shown on larger scale in FIG. 8.

In use, the user purchases a lottery ticket and a representative one of the plurality of lottery tickets 101 is removed from the lottery ticket construction 100 from a dispensing system in which the fan folded stack is stored by tearing along the row of perforations 132. It is of note the representative one of the plurality of lottery tickets 101 is now functionally identical to lottery ticket 1 described above and can be used in a similar manner as described above. The above referenced PCT Application provides further detail of the fan folded construction and the dispensing thereof. While the preferred embodiments of the invention have been described above, it will be recognized and understood that various modifications may be made therein, and the appended claims are intended to cover all such modifications which may fall within the spirit and scope of the invention.

What is claimed is:

1. A method of preparing a lottery ticket comprising:

providing a first continuous substrate sheet material in a first strip having a front surface and a rear surface;

providing a second continuous substrate sheet material in a second strip having a front surface and a rear surface;

printing promotional graphics onto said front surface of each of the first and second strips;

printing lottery game indicia onto said rear surface of said first strip wherein the lottery game indicia are applied by variable image printing;

connecting the rear surface of the first strip to the rear surface of the second strip to form a row of connected tickets;

providing between each ticket and the next a line of weakness for separation of each ticket from the next;

and providing a plurality of openable windows on the second strip so that each ticket has at least one window for exposing the second lottery game indicia on the rear surface of the first strip.

2. The method according to claim 1 wherein the lottery game indicia are applied by variable image printing onto a white lily pad.

3. The method according to claim 1 wherein the lottery game indicia are applied by variable image printing using two or more colors.

4. The method according to claim 1 wherein the lottery tickets are fan folded along each junction with the fold at the front edge of each lottery ticket construction being in a direction opposite to the fold at the rear edge of each lottery ticket construction so that the lottery ticket constructions lie each on top of and parallel to the next.

5. The method according to claim 1 wherein the lottery indicia includes a variable image bar code for validating the lottery ticket.

6. A lottery ticket construction comprising:

a first continuous substrate sheet material in a first strip having a front surface and a rear surface;

a second continuous substrate sheet material in a second strip having a front surface and a rear surface;

promotional graphics on said front surface of each of the first and second strips;

lottery game indicia printed by variable image printing onto said rear surface of said first strip;

the rear surface of the first strip being connected to the rear surface of the second strip to form a row of connected tickets;

a line of weakness between each ticket and the next for separation of each ticket from the next;

and a plurality of openable windows on the second strip so that each ticket has at least one window for exposing the second lottery game indicia on the rear surface of the first strip.

7. The lottery ticket construction according to claim 6 wherein the lottery game indicia are applied by variable image printing onto a white lily pad.

8. The lottery ticket construction according to claim 6 wherein the lottery game indicia are applied by variable image printing using two or more colors.

9. The lottery ticket construction according to claim 6 wherein the lottery tickets are fan folded along each junction with the fold at the front edge of each lottery ticket construction being in a direction opposite to the fold at the rear edge of each lottery ticket construction so that the lottery ticket constructions lie each on top of and parallel to the next.

10. The lottery ticket construction according to claim 6 wherein the lottery indicia includes a variable image bar code for validating the lottery ticket.

11. A lottery ticket construction comprising:

a first substrate sheet material having a front surface and a rear surface;

a second substrate sheet material having a front surface and a rear surface;

promotional graphics on said front surface of each of the first and second sheets;

lottery game indicia printed by variable image printing onto said rear surface of said first sheet;

the rear surface of the first sheet being connected to the rear surface of the second sheet to form a ticket;

at least one openable window on the second sheet for exposing the second lottery game indicia on the rear surface of the first sheet;

wherein the lottery game indicia includes a variable image bar code for validating the lottery ticket.

12. The lottery ticket construction according to claim 11 wherein the lottery game indicia are applied by variable image printing onto a white lily pad.

13. The lottery ticket construction according to claim 11 wherein the lottery game indicia are applied by variable image printing using two or more colors.

* * * * *